US006909864B2

(12) United States Patent
Komatsubara

(10) Patent No.: US 6,909,864 B2
(45) Date of Patent: Jun. 21, 2005

(54) IMAGE FORMING APPARATUS CONFIGURING AIR PASSAGE AND PROCESS CARTRIDGE FOR THE APPARATUS

(75) Inventor: Kazuaki Komatsubara, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/654,908

(22) Filed: Sep. 5, 2003

(65) Prior Publication Data

US 2004/0120727 A1 Jun. 24, 2004

(30) Foreign Application Priority Data

Dec. 24, 2002 (JP) ..... P2002-372470

(51) Int. Cl.[7] ..... G03G 21/20
(52) U.S. Cl. ..... 399/92
(58) Field of Search ..... 399/91, 92, 94, 399/96, 111

(56) References Cited

U.S. PATENT DOCUMENTS 5,132,731 A * 7/1992 Oda ..... 399/92
5,309,209 A * 5/1994 Huh ..... 399/92 X
5,647,727 A * 7/1997 Taniguchi et al. ..... 399/92 X
5,878,304 A * 3/1999 Watanabe et al. ..... 399/92
6,141,519 A * 10/2000 Sato ..... 399/111 X
6,173,132 B1 * 1/2001 Kida et al. ..... 399/92 X
6,219,504 B1 * 4/2001 Matsuzaki et al. ..... 399/92
6,415,118 B1 * 7/2002 Setoriyama et al. ..... 399/92
6,522,847 B2 * 2/2003 Nanjo ..... 399/92
6,754,458 B2 * 6/2004 Makihira ..... 399/92

FOREIGN PATENT DOCUMENTS

JP A-2-50169 2/1990
JP A-5-224476 9/1993

* cited by examiner

*Primary Examiner*—Sandra L. Brase
(74) *Attorney, Agent, or Firm*—Morgan Lewis & Bockius LLP

(57) ABSTRACT

A suction fan and an exhaust fan are disposed in both the sides of a process cartridge so as to be opposed to each other across the process cartridge. Air vent holes are formed in a shutter of the process cartridge. An air flow is produced through the air vent holes between a process cartridge main unit and the shutter, whereby the process cartridge is cooled.

14 Claims, 7 Drawing Sheets

IMAGE FORMING APPARATUS CONFIGURING AIR PASSAGE AND PROCESS CARTRIDGE FOR THE APPARATUS

BACKGROUND OF THE INVENTION

1. Field of the Invention

The present invention relates to an image forming apparatus having a process cartridge.

2. Description of the Related Art

In an image forming apparatus of the electrophotographic system, a toner image is transferred to a sheet, and the transferred toner image is fixed to the sheet. A process cartridge in which an image carrier and a developing device are integrally formed is used as a section for forming a toner image. Usually, a thermal pressure fixing device which performs fixation by means of heat and pressure is used in fixation of a toner image.

As a result of miniaturization of an image forming apparatus, a process cartridge and a fixing device are place in close proximity to each other. Consequently, there is a possibility that the process cartridge receives radiant heat from the fixing device to adversely affect an image carrier and a toner.

Therefore, a technique has been proposed in which a shutter disposed in a process cartridge is used for forming a gap between the shutter and a main unit of the process cartridge, and a fan is disposed to produce an air flow in the gap (for example, see JP-A-2-50169 JP-A-5-224476).

In the above two conventional arts, a single blower fan is placed in the vicinity of a process cartridge, and the single blower fan performs both air suction and exhaust, thereby causing a problem in that the cooling efficiency is poor.

SUMMARY OF THE INVENTION

It is an object of the invention to provide an image forming apparatus which can solve the problem of the conventional art, and in which a process cartridge can be efficiently cooled, and also a process cartridge which is to be used in the image forming apparatus.

In order to attain the object, a first feature of the invention is in an image forming apparatus which comprises: a process cartridge having at least an image carrier; and a fixing device which fixes an image that is formed on a sheet by the process cartridge, to the sheet, wherein a suction fan and an exhaust fan are disposed across the process cartridge to configure an air passage which produces an air flow, between the process cartridge and the fixing device. Since the suction fan and the exhaust fan are disposed respectively on both sides across the process cartridge, an air flow for cooling the process cartridge can be efficiently produced between the process cartridge and the fixing device. Preferably, the suction fan and the exhaust fan are disposed to be opposed to the process cartridge. According to the configuration, an air flow for cooling the process cartridge can be produced more efficiently between the process cartridge and the fixing device. More preferably, the suction fan or the exhaust fan is opposed to an approximately middle portion in a longitudinal direction of the process cartridge. According to the configuration, a temperature difference in the longitudinal direction which may be caused in the case where only one end portion of the process cartridge is cooled can be reduced, and hence dispersion of changes with time in members which are used in image formation can be reduced.

Preferably, the process cartridge has: a process cartridge main unit; and a shutter which is disposed in the process cartridge main unit, and which opens and closes a side face of the image carrier in accordance with attachment and detachment of the process cartridge, the shutter is retracted to a position where the shutter faces the fixing device when the process cartridge is attached, and a gap is formed between the shutter and the process cartridge main unit, thereby allowing an air flow to be formed in the gap. Radiant heat from the fixing device can be blocked by the shutter, and an air flow is produced in the gap. Therefore, the process cartridge can be cooled more efficiently.

More preferably, air vent holes which communicate with the gap are formed in the shutter. According to the configuration, the air flow to the gap can be smoothly produced. Preferably, the shutter has a hollow structure. When the shutter is formed into a hollow structure, the heat insulating property can be enhanced, and the heat insulating effect on radiant heat from the fixing device can be enhanced.

The cooling due to the air flow flowing through the air passage can be applied not only to the process cartridge, but also to a power supply device, an electric circuit board, an optical writing device, and other devices.

Preferably, the apparatus further comprises a sheet transportation guide on an upstream side of the fixing device, and air vent openings constituting the air passage are formed in the sheet transportation guide, so that exhaust is conducted through the air vent openings. Preferably, the air vent openings have an opening area which is larger than a bore area of the exhaust fan, so that the air flows more smoothly. Preferably, the air vent openings are configured by forming at least part of the sheet transportation guide into a lattice structure, so that a large opening area can be obtained while maintaining the strength of the sheet transportation guide.

A second feature of the invention is in a process cartridge which is to be used in an image forming apparatus, and which comprises: a process cartridge main unit; an image carrier housed in the process cartridge main unit; and a shutter that opens and closes an image carrier exposure window formed in the process cartridge main unit, wherein air vent holes are formed in the shutter to guide an air flow between the shutter and the process cartridge main unit. Preferably, the shutter of the process cartridge has a hollow structure as described above.

DETAILED DESCRIPTION OF THE PREFERRED EMBODIMENTS

Next, an embodiment in which the invention is applied to an actual image forming apparatus will be described.

Figure 1:
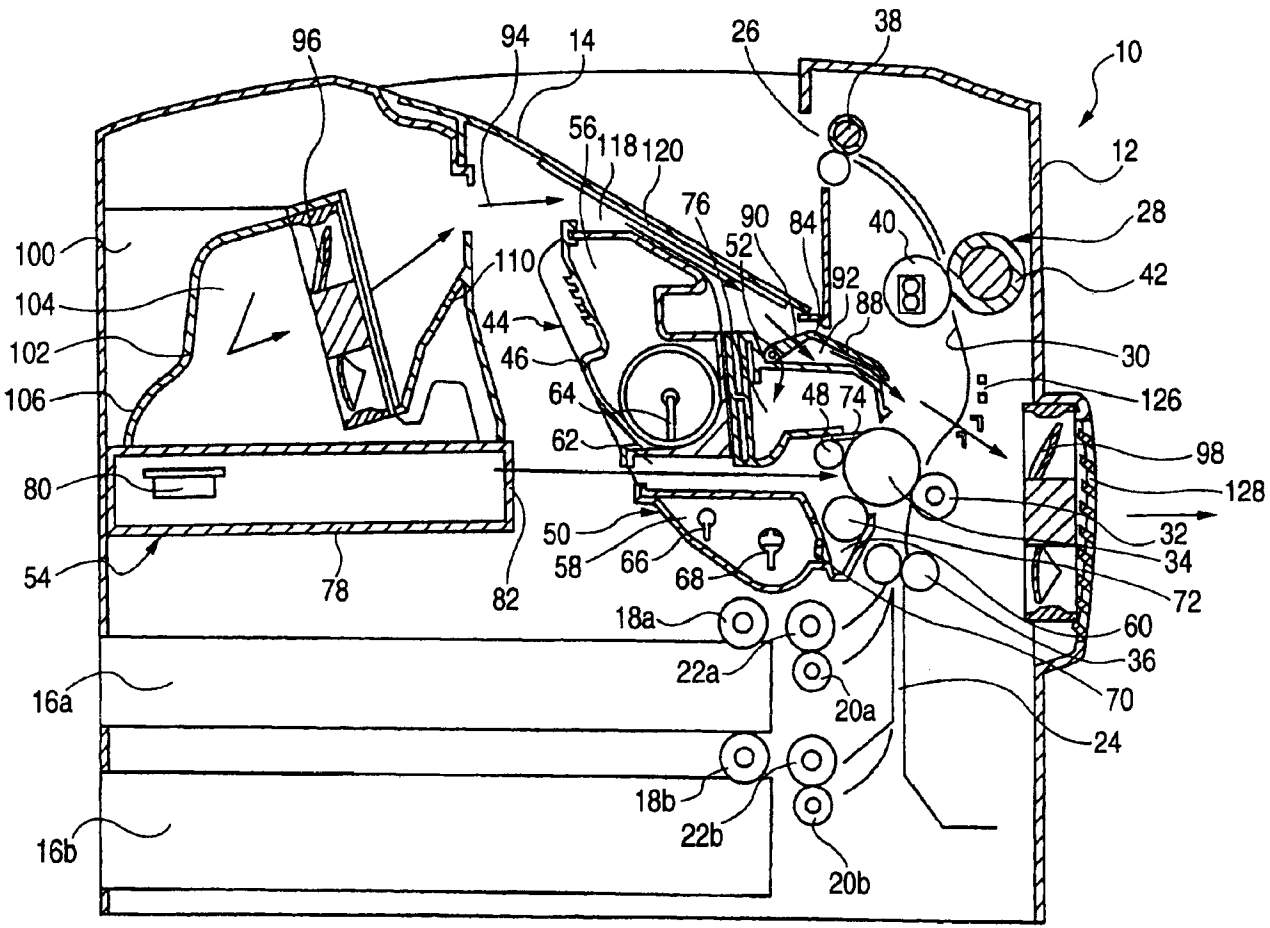
FIG. 1 is a section view showing an image forming apparatus which is an embodiment of the invention.

Referring to FIG. 1, an image forming apparatus 10 has an image forming apparatus main unit 12. A discharge section 14 is disposed in an upper part of the image forming apparatus main unit 12, and two sheet supply cassettes 16*a*, 16*b* are placed in a lower part of the image forming apparatus main unit 12.

Nudger rolls 18*a*, 18*b* are placed above the vicinities of the inner ends of the sheet supply cassettes 16*a*, 16*b*, respectively. Retard rolls 20*a*, 20*b* and feed rolls 22*a*, 22*b* are placed in front of the nudger rolls 18*a*, 18*b*.

A transportation path 24 is a sheet passage elongating from the nudger roll 18*b* for the lower sheet supply cassette 16*b* to a discharge port 26. The transportation path 24 has a portion which is in the vicinity of the rear face (the right side face in FIG. 1) of the image forming apparatus main unit 12, and which is formed substantially vertically in a range from the feed roll 22*b* for the lower sheet supply cassette 16*b* to a fixing device 28 that will be described later. In the transportation path 24, a transferring device 32 and an image carrier 34 which will be described later are placed via a sheet transportation guide 30 on the upstream side of the fixing device 28, and a registration roll 36 is placed on the upstream side of the transferring device 32 and the image carrier 34. A discharge roll 38 is placed in the vicinity of the discharge port 26 of the transportation path 24.

Therefore, a sheet which is selectively fed out from one of the sheet supply cassettes 16*a*, 16*b* by the nudger roll 18*a* or 18*b* is separated by the retard roll 20*a* or 20*b* and the feed roll 22*a* or 22*b*, and then guided into the transportation path 24. The sheet is temporarily stopped by the registration roll 36, and then timely passed between the transferring device 32 and the image carrier 34 so that the toner image is transferred to the sheet. The transferred toner image is fixed by the fixing device 28, and the sheet is then discharged to the discharge section 14 via the discharge port 26.

The discharge section 14 is inclined so that the discharge port side is lower and the section is gradually raised as advancing toward the front face (the leftward direction in FIG. 1). The discharge section 14 is supported by the image forming apparatus main unit 12 so as to be swingable about the lower end of the section. When the discharge section 14 is upward swung to be opened, a process cartridge 44 which will be described later can be attached to and detached from the apparatus.

The fixing device 28 is configured by, for example, a heat roll 40 and a pressurization roll 42. The heat roll 40 and the pressurization roll 42 pressingly contact each other to form a nip portion. When a sheet is passed through the nip portion, a toner image is fixed to the sheet. The fixing device 28 is positioned in the vicinity of the process cartridge 44. In the embodiment, particularly, the heat roll 40 is placed so as to be opposed to the process cartridge 44.

Figure 2:
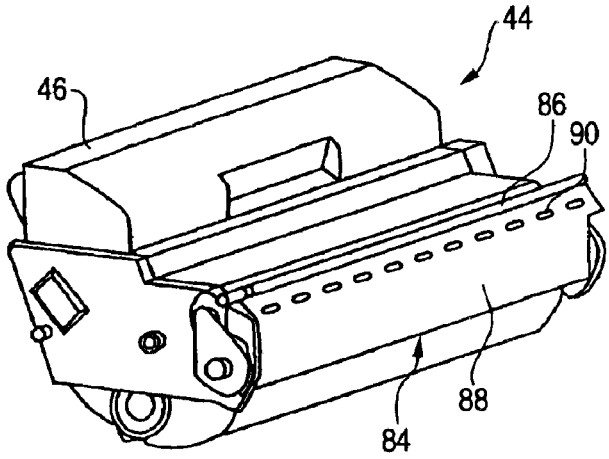
FIG. 2 is a perspective view showing a process cartridge which is used in the image forming apparatus of the embodiment of the invention.

As shown also in FIG. 2, the process cartridge 44 has a process cartridge main unit 46. The image carrier 34, a charging device 48, a developing device 50, and a cleaning device 52 are integrally housed in the process cartridge main unit 46. The image carrier 34 is formed by a photosensitive member or the like, and a latent image is formed on the image carrier by an optical writing device 54 which will be described later. The transferring device 32 which is configured by, for example, a transfer roll is placed so as to be opposed to the image carrier 34. The charging device 48 is configured by, for example, a charging roll, and rotated with contacting with the image carrier 34 to uniformly charge the image carrier 34.

The developing device 50 develops the latent image formed on the image carrier 34 by a toner, and has a first toner chamber 56, a second toner chamber 58, and a development chamber 60. The first toner chamber 56 and the second toner chamber 58 are vertically arranged across an opening 62. A first toner stirring and transporting member 64 is placed in the first toner chamber 56, and second to fourth stirring and transporting members 66, 68, and 70 are placed in the second toner chamber 58 to transport a toner to the development chamber 60. The opening 62 is formed so that a scanning beam emitted from the optical writing device 54 which will be described later passes therethrough. The first toner chamber 56 and the second toner chamber 58 communicate with each other through both sides of the opening 62, so that a toner in the first toner chamber 56 is transported into the second toner chamber 58. A development roll 72 is placed in the development chamber 60. The development roll 72 causes a toner image to be carried on a latent image on the image carrier 34.

The cleaning device 52 has, for example, a cleaning blade 74 and a toner recovery chamber 76, so that a toner which is scraped off by the cleaning blade 74 is recovered into the toner recovery chamber 76.

The optical writing device 54 is placed in the image forming apparatus main unit 12, and in the vicinity of the front face (in the vicinity of the right end in FIG. 1) of the image forming apparatus main unit 12 so as to be parallel to the sheet supply cassettes 16*a*, 16*b*. The optical writing device 54 has an optical writing device main unit 78. A polygon unit 80 consisting of a polygon mirror and a motor for rotating the polygon mirror, a semiconductor laser (not shown), and other optical components (not shown) are housed in the optical writing device main unit 78. The scanning beam is emitted through an emission window 82 which is formed in the optical writing device main unit 78 on the side of the process cartridge. The scanning beam then impinges on the image carrier 34 via the opening 62 of the process cartridge 44.

Figure 3:
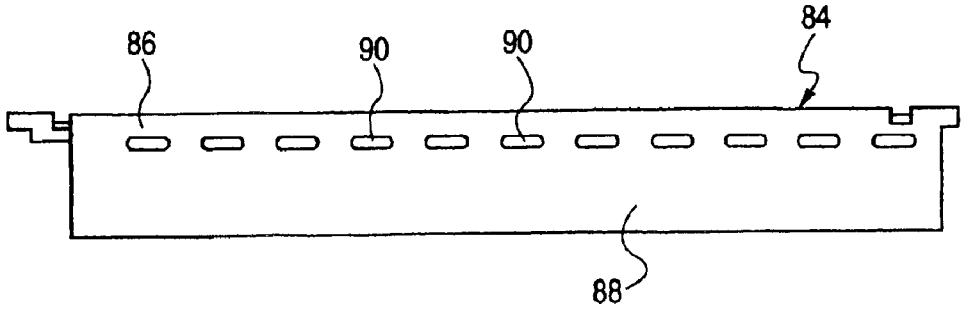
FIG. 3 is a plan view showing a shutter which is used in the process cartridge of the embodiment of the invention.

The process cartridge 44 has a shutter 84 which opens and closes a side face of the image carrier 34 on the side of the transferring device 32. As shown also in FIG. 3, the shutter 84 has: a support portion 86 which is supported swingably and movably by the process cartridge main unit 46; and a shield portion 88 which extends from the support portion 86. The shutter 84 is guided by a guide (not shown) disposed in the image forming apparatus main unit 12 so as to be opened and closed in conjunction with attachment and detachment of the process cartridge 44. Namely, when the process cartridge 44 is not attached to the apparatus, the shutter 84 is closed by an elastic member (not shown) to protect the side face portion of the image carrier 34 as shown in FIG. 2. When the process cartridge 44 is attached to the apparatus, the shutter 84 is moved against the elastic member to a retract position where the side face portion of the image carrier 34 is exposed as shown in FIG. 1. In the retract position, the shield portion 88 is opposed to the heat roll 40 of the fixing device 28 to block radiant heat from the heat roll 40, thereby preventing the process cartridge 44 from being heated.

Figure 4:
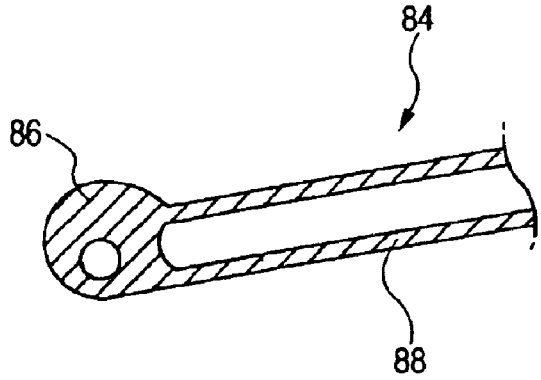
FIG. 4 is an enlarged partial section view showing the shutter which is used in the process cartridge of the embodiment of the invention.

In the shutter 84, a large number of air vent holes 90 are formed in parallel with the support portion 86 and in the shield portion 88 in the vicinity of the support portion. When the shutter 84 is in the retract position, a first gap 92 is formed between the shutter 84 and the process cartridge main unit 46. The air vent holes 90 communicate with the first gap 92. The first gap 92 constitutes part of an air passage 94 which will be described later. An air flow is produced in the first gap 92 by air which is introduced through the air vent holes 90, to cool the process cartridge 44. In the shutter 84, as shown in FIG. 4, the shield portion 88 has a hollow structure, so that the heat insulating property of the shield portion 88 is enhanced by the air inside the shield portion 88.

A suction fan 96 is placed inside the image forming apparatus main unit 12 and above the optical writing device 54. An exhaust fan 98 is placed in approximately the middle of the rear face side of the image forming apparatus main unit 12. Therefore, the suction fan 96 and the exhaust fan 98 are placed respectively on both sides of the process cartridge 44 so as to be opposed to each other across the process cartridge 44 in an approximately middle portion in the longitudinal direction of the process cartridge 44. An air flow indicated by the arrows in FIG. 1 is produced by the suction fan 96 and the exhaust fan 98. The air passage 94 is a passage for forming the air flow. The suction fan 96 is not always required to be opposed straight to the process cartridge 44 as shown in FIG. 1, and may be placed at an arbitrary angle in accordance with the degree of the air flow and the portion to be cooled. For example, the fan may be placed in a direction parallel to a line perpendicular to the plane of the sheet of FIG. 1 so as to be opposed straight to a power supply device 100 which will be described later.

Next, the air passage 94 will be described in detail.

The air passage 94 has a suction port (not shown) which is formed in a side face of the image forming apparatus main unit 12. The suction port is connected to a first duct 102 through the power supply device 100 which is placed in parallel with the side face of the image forming apparatus main unit 12, thereby cooling the power supply device 100. An electric circuit board may be placed in place of the power supply device 100, or an electric circuit board may be placed together with the power supply device 100.

Figure 5:
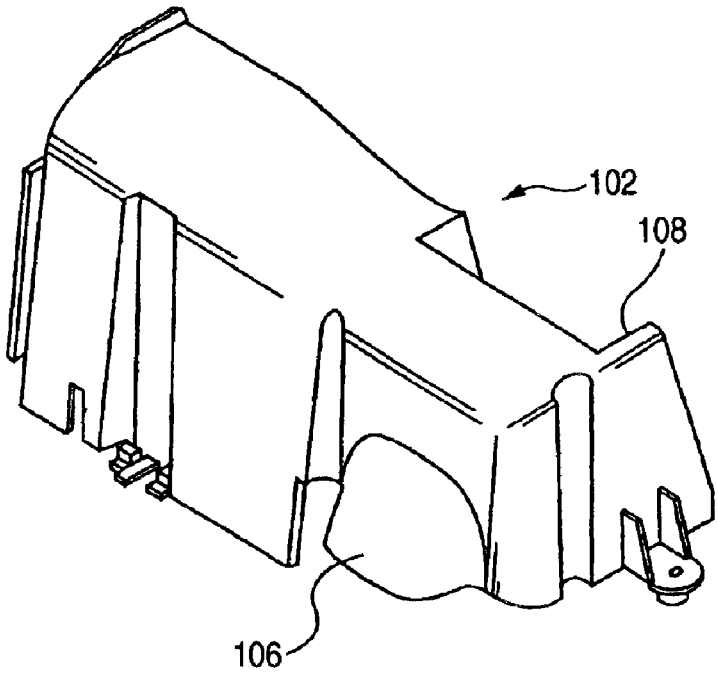
FIG. 5 is a perspective view as viewed from the front side showing a first duct which is used in the image forming apparatus of the embodiment of the invention.
Figure 6:
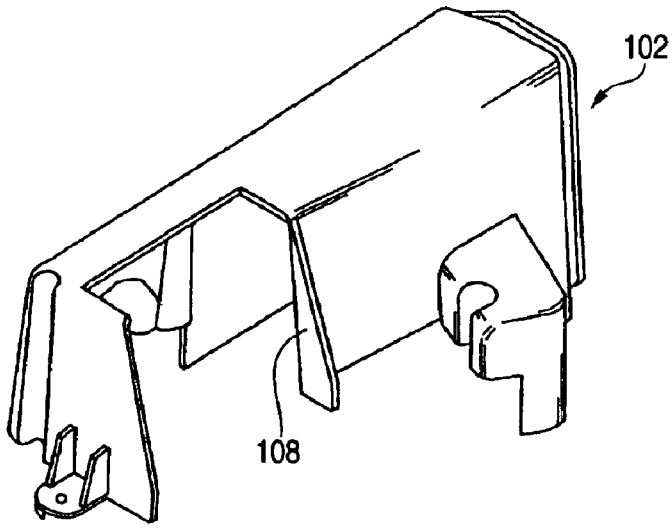
FIG. 6 is a perspective view as viewed from the rear side showing the first duct which is used in the image forming apparatus of the embodiment of the invention.
Figure 8:
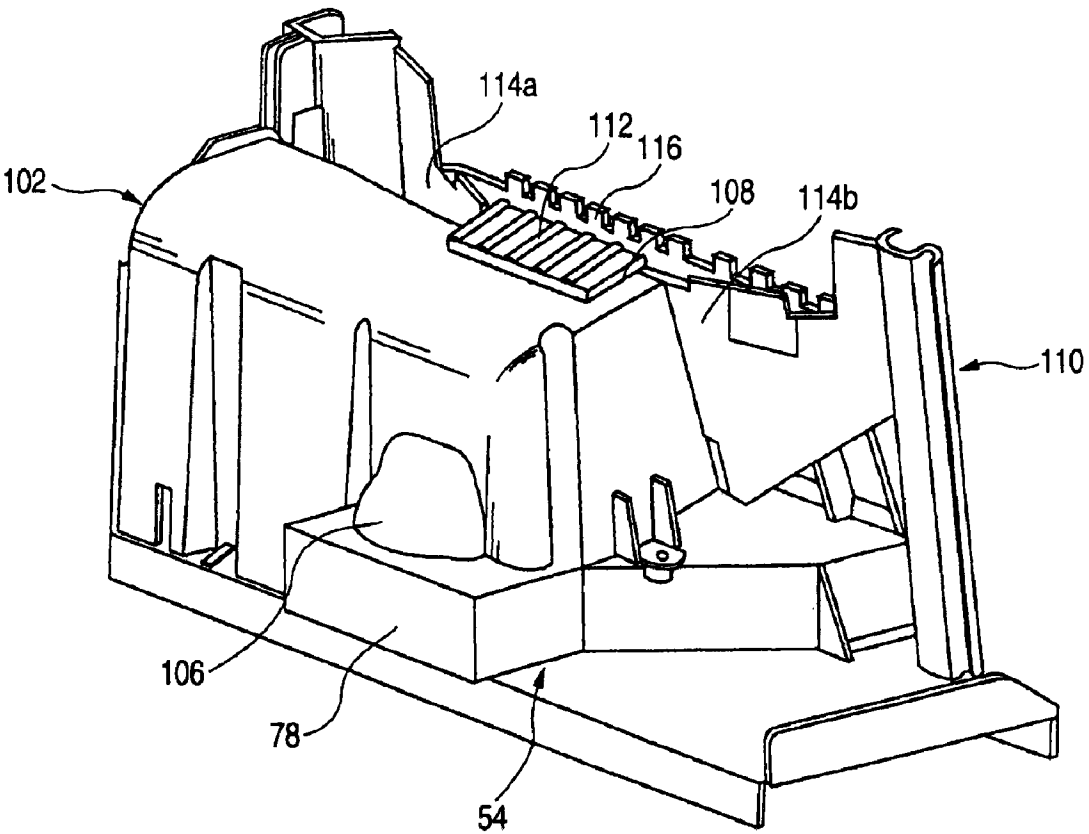
FIG. 8 is a perspective view as viewed from the front side showing a state where an optical writing device, a first duct, and a second duct which are used in the image forming apparatus of the embodiment of the invention are combined with one another.
Figure 9:
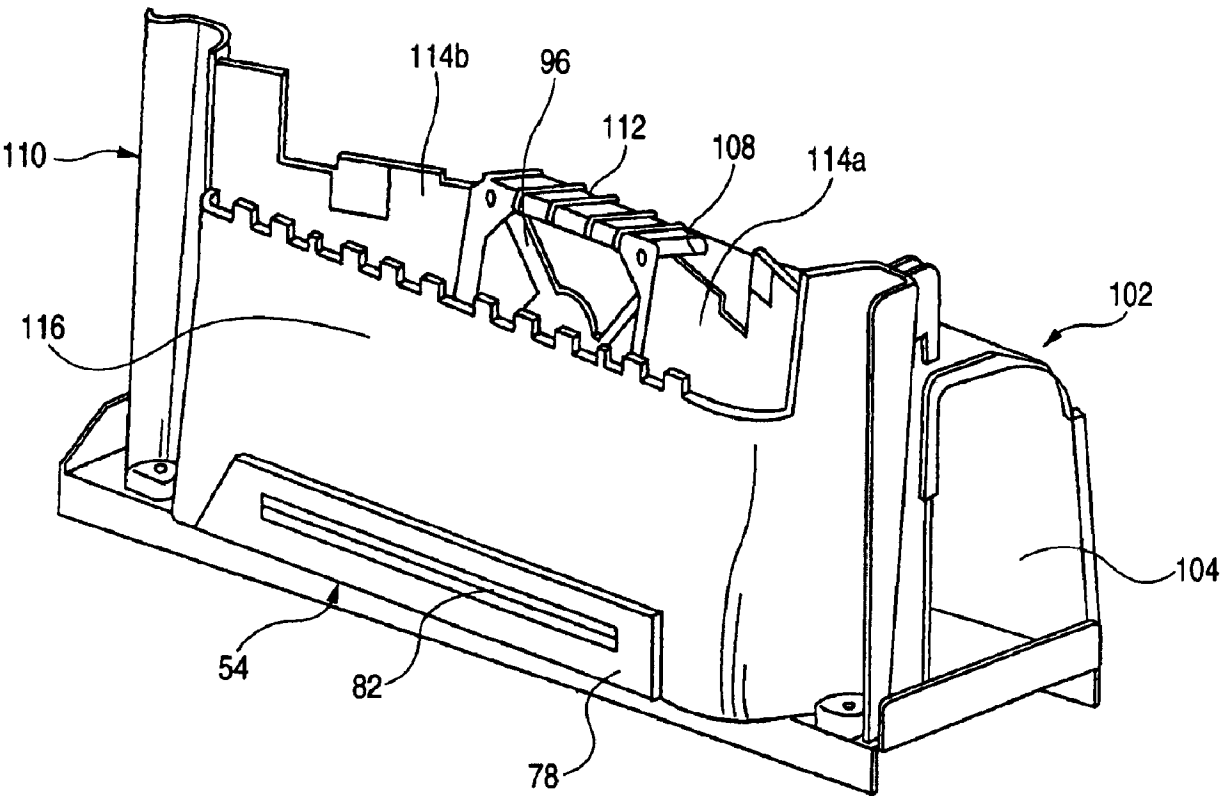
FIG. 9 is a perspective view as viewed from the rear side showing a state where the optical writing device, the first duct, and the second duct which are used in the image forming apparatus of the embodiment of the invention are combined with one another.

In the first duct 102, as shown also in FIG. 9, an inlet 104 which is opposed to the power supply device 100 is formed in one end. The first duct 102 elongates from the inlet 104 to an approximately middle portion of the optical writing device 54. As shown also in FIGS. 5, 6, and 8, a projection 106 is formed on the front face (the left side in FIG. 1) of the elongating portion. The projection 106 is opposed to the polygon unit 80 of the optical writing device 54, so that air is introduced into the projection 106 to conduct efficient cooling particularly on the polygon unit 80. A suction fan receiving portion 108 is formed in the rear face side (the right side in FIG. 1) of the first duct 102. The suction fan 96 is insertedly placed in the suction fan receiving portion 108.

Figure 7:
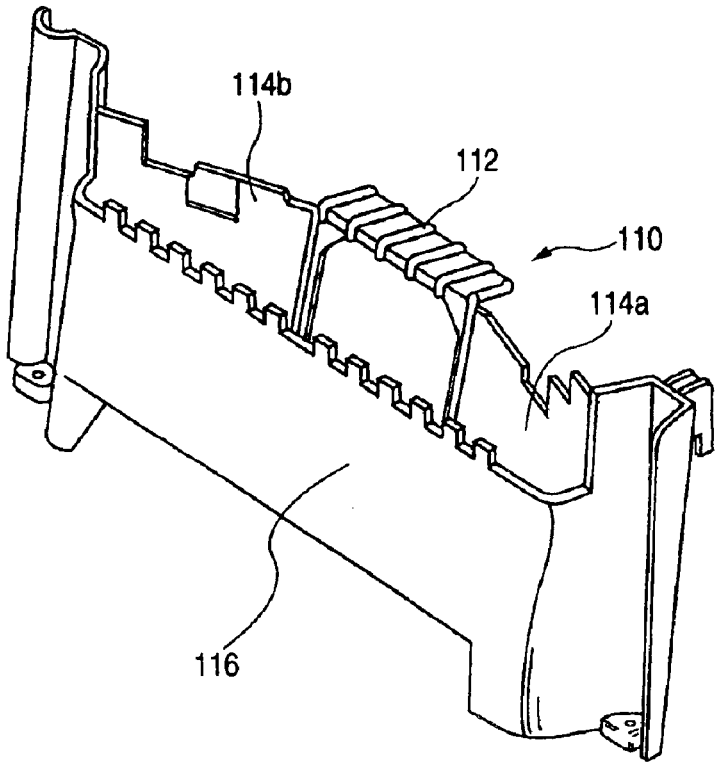
FIG. 7 is a perspective view as viewed from the rear side showing a second duct which is used in the image forming apparatus of the embodiment of the invention.

A second duct 110 is connected to the first duct 102 in the suction fan receiving portion 108 of the first duct 102, and attached together with the first duct 102 to an upper portion of the optical writing device 54. In the second duct 110, as shown also in FIG. 7, a suction fan attachment portion 112 is disposed in approximately the middle of the front face. The suction fan 96 is attached to the suction fan attachment portion 112. The second duct 110 has first air guide faces 114*a*, 114*b* which laterally extend from the suction fan attachment portion 112 to the respective sides. A second air guide face 116 is disposed so as to be opposed to the first air guide faces 114*a*, 114*b*. Therefore, the air flow from the suction fan 96 is guided by the first air guide faces 114*a*, 114*b* and the second air guide face 116 to be spread to both the sides, and then supplied toward the process cartridge 44 with passing over the second air guide face 116.

A second gap 118 is formed above the first toner chamber 56 and between the process cartridge main unit 46 and the discharge section 14. In the discharge section 14, a large number of air guide ribs 120 which protrude into the second gap 118 are formed in parallel with the air flow direction. Air flows to the sheet transportation guide 30 through the second gap 118 and the first gap 92.

Figure 10:
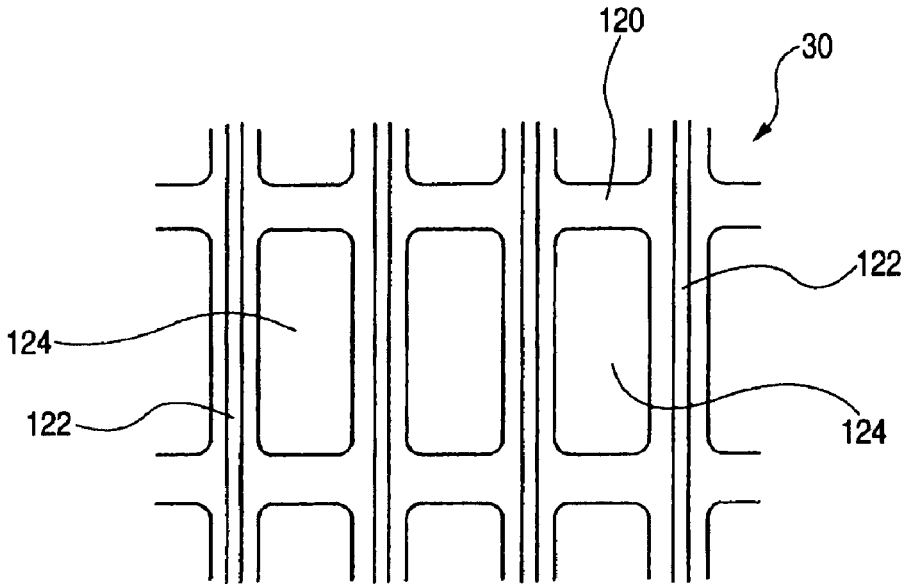
FIG. 10 is a front view showing a sheet transportation guide which is used in the image forming apparatus of the embodiment of the invention.

As shown in FIG. 10, the sheet transportation guide 30 has: a guide body 122; and many sheet transportation ribs 124 which protrude from the guide body 122 and elongate in parallel with the sheet transportation direction. The guide body 122 is formed into a lattice-like shape. A large number of air vent openings 126 are formed between the sheet transportation ribs 124. The total opening area of the air vent openings 126 is larger than the bore area of the exhaust fan 98, and hence air can smoothly flow through the air vent openings 126. An exhaust port 128 is formed outside the exhaust fan 98 so that air is discharged through the exhaust port 128.

Next, the function of the air cooling system based on the suction fan 96 and the exhaust fan 98 will be described.

When the suction fan 96 and the exhaust fan 98 are rotated, air is sucked trough an air suction port (not shown) which is formed in the side face of the image forming apparatus main unit 12, and then introduced into the first duct 102 through the power supply device 100. At this time, the sucked air absorbs heat from the power supply device 100 to cool the device. The air which is introduced into the first duct 102 is guided into the projection 106 to absorb heat from the optical writing device 54, particularly, from the polygon unit 80, thereby cooling the optical writing device 54. Thereafter, the air passes through the suction fan 96 to enter the second duct 110. In the second duct 110, the air flow is spread to both the sides by the first air guide faces 114*a*, 114*b* and the second air guide face 116, and then passes through an upper portion of the second duct 110 to be directed toward the process cartridge 44. Since the second gap 118 is formed between the process cartridge 44 and the discharge section 14, the air passes through the second gap 118. Since the air vent holes 90 are formed in the shutter 84 and the first gap 92 is formed between the process cartridge main unit 46 of the process cartridge 44 and the shutter 84, moreover, the air passes through the first gap 92. The radiant heat from the fixing device 28 is blocked to some extent by the shield portion 88 of the shutter 84. Furthermore, the heat of the process cartridge 44 is absorbed by the air flow passing through the first gap 92, whereby the process cartridge 44 is cooled. Thereafter, the air passes through the lattice-like air vent openings 126 formed in the sheet transportation guide 30, and then discharged to the outside of the image forming apparatus from the exhaust port 128 via the exhaust fan 98.

As described above, according to the invention, a suction fan and an exhaust fan are disposed respectively on both sides across a process cartridge, and hence the process cartridge can be efficiently cooled.

What is claimed is:

1. An image forming apparatus comprising:

a process cartridge having at least an image carrier; and a fixing device which fixes an image that is formed on a sheet by said process cartridge, to the sheet, wherein a suction fan and an exhaust fan are disposed across said process cartridge to configure an air passage which produces an air flow, between said process cartridge and said fixing device, the process cartridge and the fixing device are disposed on a transportation path, which extends from downward to upward, and on which a sheet is transported, and an air flow which gets across the transportation path between an upper portion of the process cartridge and a lower portion of the fixing device.

2. The image forming apparatus according to claim 1, wherein said suction fan and said exhaust fan are disposed to be opposed to said process cartridge.

3. The image forming apparatus according to claim 1, wherein said suction fan or said exhaust fan is disposed to be opposed to an approximately middle portion in a longitudinal direction of said process cartridge.

4. The image forming apparatus according to clam 1, wherein said process cartridge has: a process cartridge main unit; and a shutter which is disposed in said process cartridge main unit, and which opens and closes a side face of said image carrier in accordance with attachment and detachment of said process cartridge, said shutter is retracted to a position where said shutter faces said fixing device when said process cartridge is attached, and a gap is formed between said shutter and said process cartridge main unit, thereby allowing an air flow to be formed in said gap.

5. The image forming apparatus according to claim 4, wherein air vent holes which communicate with said gap are formed in said shutter.

6. The image forming apparatus according to claim 4, wherein said shutter has a hollow structure.

7. The image forming apparatus according to claim 1, wherein said apparatus further comprises a power supply device, and said power supply device is cooled by an air flow which passes through said air passage.

8. The image forming apparatus according to claim 1, wherein said apparatus further comprises an electric circuit board, and said electric circuit board is cooled by an air flow which passes through said air passage.

9. The image forming apparatus according to claim 1, wherein said apparatus further comprises an optical writing device, and said optical writing device is cooled by an air flow which passes through said air passage.

10. The image forming apparatus according to claim 1, wherein said apparatus further comprises a sheet transportation guide on an upstream side of said fixing device, and air vent openings constituting said air passage are formed in said sheet transportation guide.

11. The image forming apparatus according to claim 10, wherein said air vent openings have an opening area which is larger than a bore area of said exhaust fan.

12. The image forming apparatus according to claim 10, wherein said air vent openings are configured by forming at least part of said sheet transportation guide into a lattice structure.

13. A process cartridge for use in an image forming apparatus, comprising:

a process cartridge main unit;

an image carrier housed in said process cartridge main unit; and a shutter that opens and closes an image carrier side face formed in said process cartridge main unit, wherein air vent holes are formed in said shutter to guide an air flow between said shutter and said process cartridge main unit.

14. The process cartridge according to claim 13, wherein said shutter has a hollow structure.

* * * * *